US010215458B2

(12) United States Patent
Esformes et al.

(10) Patent No.: US 10,215,458 B2
(45) Date of Patent: Feb. 26, 2019

(54) EVAPORATOR DISTRIBUTION SYSTEM AND METHOD

(71) Applicant: Carrier Corporation, Farmington, CT (US)

(72) Inventors: Jack Leon Esformes, Jamesville, NY (US); Marcel Christians, Skaneateles, NY (US); Satyam Bendapudi, Fayetteville, NY (US)

(73) Assignee: CARRIER CORPORATION, Farmington, CT (US)

( * ) Notice: Subject to any disclaimer, the term of this patent is extended or adjusted under 35 U.S.C. 154(b) by 513 days.

(21) Appl. No.: 14/768,754

(22) PCT Filed: Feb. 10, 2014

(86) PCT No.: PCT/US2014/015553
§ 371 (c)(1),
(2) Date: Aug. 18, 2015

(87) PCT Pub. No.: WO2014/130282
PCT Pub. Date: Aug. 28, 2014

(65) Prior Publication Data

US 2016/0003508 A1 Jan. 7, 2016

Related U.S. Application Data

(60) Provisional application No. 61/766,346, filed on Feb. 19, 2013.

(51) Int. Cl.
*F25B 39/02* (2006.01)
*F28D 5/02* (2006.01)
(Continued)

(52) U.S. Cl.
CPC ..... *F25B 39/028* (2013.01); *F24F 1/0059* (2013.01); *F28D 3/04* (2013.01);
(Continued)

(58) Field of Classification Search
CPC ..... F28D 3/04; F25B 2339/021
(Continued)

(56) References Cited

U.S. PATENT DOCUMENTS 3,356,125 A * 12/1967 Standiford, Jr. ..... B01D 1/065 159/13.2
4,291,544 A 9/1981 Larsen
(Continued)

FOREIGN PATENT DOCUMENTS

CN 1185203 A 6/1998
CN 101954195 A 1/2011
(Continued)

OTHER PUBLICATIONS

Chinese First Office Action and Search Report for application CN201480009415.3, dated May 15, 2017, 9pgs.
(Continued)

*Primary Examiner* — Allen Flanigan
(74) *Attorney, Agent, or Firm* — Cantor Colburn LLP

(57) ABSTRACT

A falling film evaporator (12) for a heating ventilation and cooling (HVAC) system includes a housing (52) and a plurality of evaporator tubes (26) positioned at least partially in the housing (52) through which a volume of thermal energy transfer medium is flowed. A distribution system (34) is located in the housing to distribute a flow of liquid refrigerant (20) over the plurality of evaporator tubes (26). The distribution system (34) includes a distribution vessel having a plurality of drip openings (38) to flow the liquid refrigerant onto the plurality of evaporator tubes (26), a feed pipe (42) to flow refrigerant into the distribution box (36), and one or more pressure regulators (58) in the distribution system, thereby regulating the flow of liquid refrigerant.

9 Claims, 3 Drawing Sheets

(51) Int. Cl.
*F28F 25/02* (2006.01)
*F28F 27/02* (2006.01)
*F28D 3/04* (2006.01)

(52) U.S. Cl.
CPC ..... *F28D 5/02* (2013.01); *F28F 25/02* (2013.01); *F28F 27/02* (2013.01); *F25B 2339/021* (2013.01); *F25B 2339/0242* (2013.01); *F25B 2400/23* (2013.01); *F25B 2500/18* (2013.01)

(58) Field of Classification Search
USPC ..... 165/115, 117, 301
See application file for complete search history.

(56) References Cited

U.S. PATENT DOCUMENTS 4,683,025 A 7/1987 Flores
4,810,327 A 3/1989 Norrmen
5,184,473 A 2/1993 Day
5,385,034 A 1/1995 Haselden
5,561,987 A 10/1996 Hartfield et al.
5,588,596 A * 12/1996 Hartfield et al. ..... B01D 1/04 165/117
5,839,294 A 11/1998 Chiang et al.
6,167,713 B1 1/2001 Hartfield et al.
6,293,112 B1 9/2001 Moeykens et al.
6,389,830 B2 5/2002 Bottum, Sr. et al.
6,606,882 B1 * 8/2003 Gupte ..... F25B 39/028 165/115
6,868,695 B1 3/2005 Dingel et al.
7,044,200 B2 5/2006 Gupte et al.
7,849,710 B2 12/2010 De Larminat et al.
7,913,504 B2 3/2011 Lu et al.
7,959,768 B2 6/2011 Porscha et al.
2009/0178790 A1 7/2009 Schreiber et al.

FOREIGN PATENT DOCUMENTS

CN 102788451 A 11/2012
KR 20110004149 A 1/2011
KR 20120082077 A 7/2012

OTHER PUBLICATIONS

Notification of Transmittal of the International Search Report and the Written Opinion of the International Searching Authority; PCT/US2014/01553; EP Patent Office; dated Jun. 16, 2014; ISR 5 pages; WO 5 pages.

* cited by examiner

EVAPORATOR DISTRIBUTION SYSTEM AND METHOD

BACKGROUND

The subject matter disclosed herein relates to heating, ventilation and air conditioning (HVAC) systems. More specifically, the subject matter disclosed herein relates to evaporators for HVAC systems.

HVAC systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. This results in a particularly high volume of refrigerant necessary, depending on a quantity and size of evaporator tubes, for efficient system operation. Another type of evaporator used in chiller systems is a falling film evaporator. In a falling film evaporator, the evaporator tubes are positioned typically below a distribution manifold from which refrigerant is urged, forming a "falling film" on the evaporator tubes.

In one type of falling film evaporator, the distribution system includes a plurality of sprayers from which a vapor-liquid refrigerant mixture is sprayed directly onto the evaporator tubes, requiring complex and costly distribution systems and sprayer assemblies. In another, a separator is used to separate vapor refrigerant from liquid refrigerant, and the system relies on gravity working through a column of liquid refrigerant to drip the liquid refrigerant onto the evaporator tubes. This system requires the addition of the separator, and a considerable refrigerant charge to effect the gravity feed.

BRIEF SUMMARY

In one embodiment, a falling film evaporator for a heating ventilation and cooling (HVAC) system includes a housing and a plurality of evaporator tubes positioned at least partially in the housing through which a volume of thermal energy transfer medium is flowed. A distribution system is located in the housing to distribute a flow of liquid refrigerant over the plurality of evaporator tubes. The distribution system includes a distribution vessel having a plurality of drip openings to flow the liquid refrigerant onto the plurality of evaporator tubes, a feed pipe to flow refrigerant into the distribution box, and one or more pressure regulators in the distribution system, thereby regulating the flow of liquid refrigerant.

In another embodiment, a heating, ventilation and air conditioning (HVAC) system includes a condenser flowing a flow of refrigerant therethrough, and a falling film evaporator in flow communication with the condenser. The falling film evaporator includes a housing and a plurality of evaporator tubes positioned at least partially in the housing through which a volume of thermal energy transfer medium is flowed. A distribution system is located in the housing to distribute a flow of liquid refrigerant over the plurality of evaporator tubes. The distribution system includes a distribution vessel having a plurality of drip openings to flow the liquid refrigerant onto the plurality of evaporator tubes, a feed pipe to flow refrigerant into the distribution box, and one or more pressure regulators in the distribution system, thereby regulating the flow of liquid refrigerant. The system further includes a compressor to receive a flow of vapor refrigerant from the falling film evaporator.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
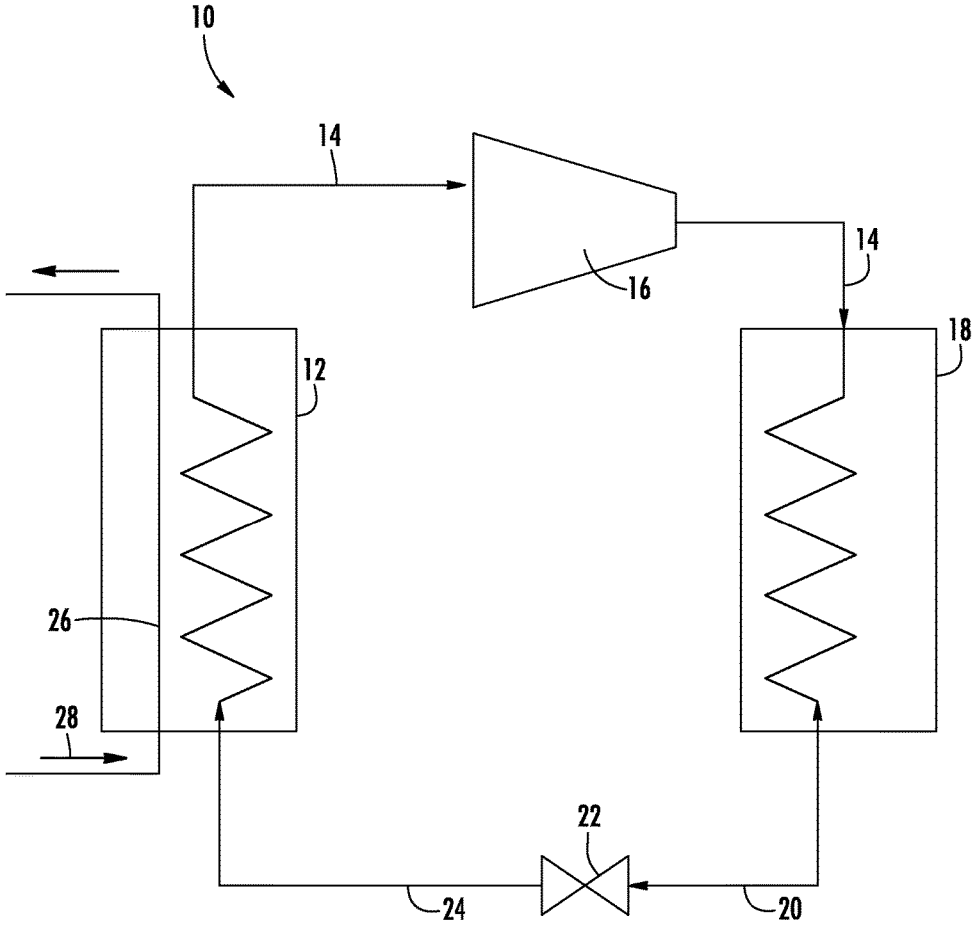
FIG. 1 is a schematic view of an embodiment of a heating, ventilation and air conditioning system.

The detailed description explains embodiments of the invention, together with advantages and features, by way of example with reference to the drawing.

DETAILED DESCRIPTION

Shown in FIG. 1 is a schematic view an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 to the evaporator 12. A thermal energy exchange occurs between a flow of heat transfer medium 28 flowing through a plurality of evaporator tubes 26 into and out of the evaporator 12 and the vapor and liquid refrigerant mixture 24. As the vapor and liquid refrigerant mixture 24 is boiled off in the evaporator 12, the vapor refrigerant 14 is directed to the compressor 16.

Figure 2:
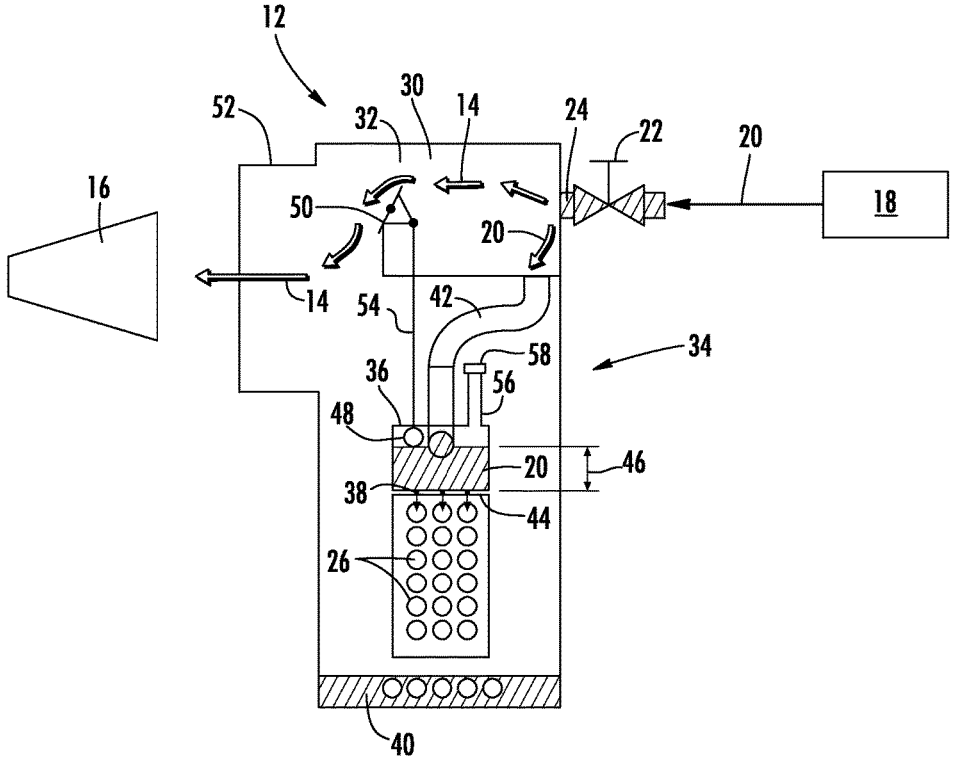
FIG. 2 is a schematic view of an embodiment of a falling film evaporator for an HVAC system.

Referring now to FIG. 2, as stated above, the evaporator 12 is a falling film evaporator. The evaporator 12 of FIG. 2 utilizes a pressure assist to significantly reduce the amount of refrigerant in the system 10 compared to those utilizing a prior art gravity-fed evaporator. Further, the evaporator 12 makes possible the use of a smaller separator, which may be incorporated into the evaporator 12 structure.

The evaporator 12 includes housing 52 with the evaporator 12 components disposed at least partially therein, including a separator 30 to separate liquid refrigerant 20 and vapor refrigerant 14 from the vapor and liquid refrigerant mixture 24. Vapor refrigerant 14 is routed from the separator 30 through a suction port 32 and toward the compressor 16, while the liquid refrigerant 20 is routed toward a distribution system 34 of the evaporator 12. The distribution system 34 includes a distribution box 36 having a plurality of drip openings 38 arrayed along a bottom surface 44 of the distribution box 36. Though in the embodiment of FIG. 2 the distribution box 36 is substantially rectangular in cross-section, it is to be appreciated that the distribution box 36 may have another cross-sectional shape, for example, T-shaped or oval shaped. The distribution box 36 and drip openings 38 are configured to drip liquid refrigerant 20 onto evaporator tubes 26 and resulting in the falling film terminating in a refrigerant pool 40 at a bottom of the evaporator 12. A feed pipe 42 extends from the separator 30 into the distribution box 36 and terminates in the distribution box 36. Flow of the liquid refrigerant 20 into the distribution box 36 results in the collection of a volume of liquid refrigerant 20, or liquid head 46, in the distribution box 36 prior to flowing through the drip openings 38. In some embodiments, a vent 56 may be located at the distribution system 34, for example, at the distribution box 36 to allow escape of vapor refrigerant 14 that makes its way into the distribution system 34 from the separator 30 thereby preventing an unwanted buildup of vapor refrigerant 14 in the distribution system 34. In some embodiments, the vent 56 includes a pressure regulator 58, which may be, for example, a fixed orifice or orifices, a metered orifice or a controlled venting device that vents an amount of vapor refrigerant 14 (based on pressure in the separator 20) necessary to effect 100% liquid refrigerant 20 feed to the drip openings 38.

In prior art gravity fed evaporators, under some system operating conditions, such as high load conditions, a high level of liquid head is necessary to force flow of liquid refrigerant through the distribution system at the required rate to meet high load needs. Thus, a large amount of refrigerant charge is necessary in such prior art evaporators. This necessarily high level of liquid head consequently increases the refrigeration system height.

To reduce an amount of refrigerant and system height necessary to drive the flow through the evaporator at high load operating conditions, the evaporator 12 includes a liquid head 46 level sensor in the distribution box 36, for example, a float 48. While a float 48 is utilized in the embodiment of FIG. 2, it is to be appreciated that other types of level sensors may be utilized. The float 48 is operably connected to a damper 50 or valve or other pressure regulator at the suction port 32 at the separator 30. With the damper 50 in an open position, vapor refrigerant 14 separated out of the refrigerant at the separator 30 flows through the suction port 32 toward the compressor 16, since pressure in the separator, $P_s$, is greater than a pressure, $P_e$, on the opposite side of the suction port 32. Under high load conditions, as the liquid head 46 level rises, the float 48 also rises and urges the damper 50 toward a closed position via a connection, either mechanical, electrical, fluid or the like, between the float 48 and the damper 50. In the embodiment of FIG. 2, the connection is, for example, a mechanical linkage 54. With the damper 50 moved toward a closed position, the pressure of vapor refrigerant 14, $P_s$ builds in the separator 30 and the distribution system 34, thus urging increased flow of the liquid refrigerant 20 through the distribution system 34. Conversely, under low load conditions, the liquid head level 46 drops, allowing the damper 50 to move toward the opened position. This "turns off" the pressure-assist and forces the liquid refrigerant 20 to flow through the distribution system 34 by gravity.

Figure 3:
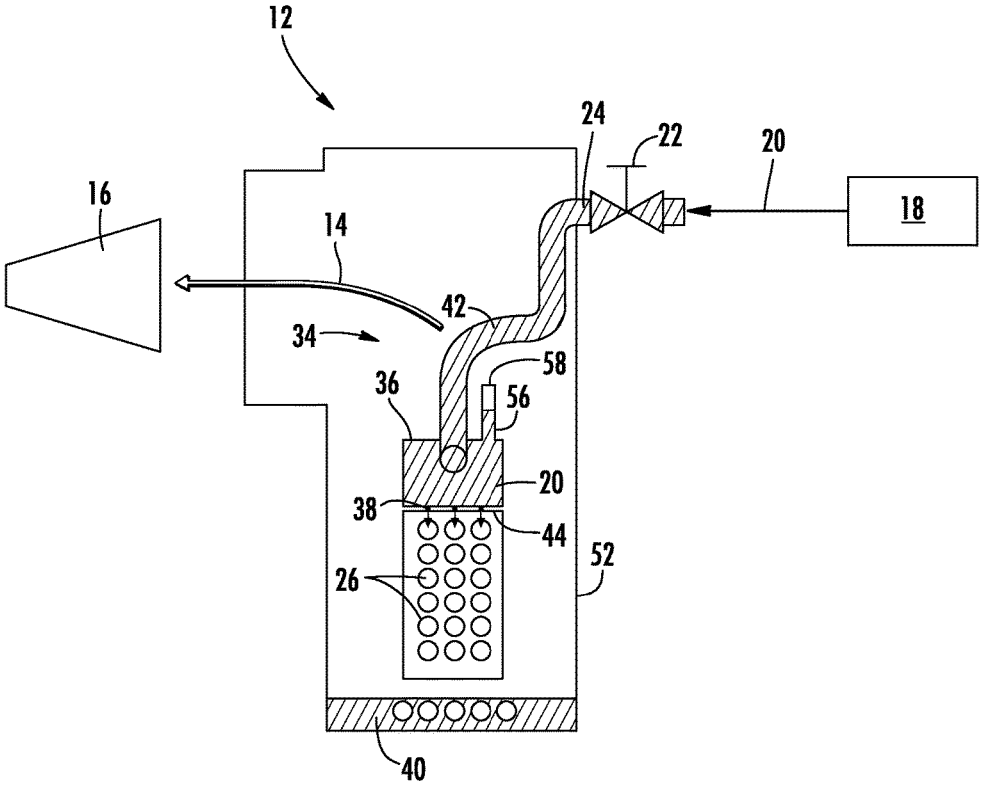
FIG. 3 is a schematic view of another embodiment of a falling film evaporator for an HVAC system.

Another embodiment of a gravity-fed evaporator 12 is shown in FIG. 3, illustrating a "direct feed" approach. In a direct feed evaporator 12, the vapor and liquid refrigerant mixture 24 is routed from the expansion valve 22 directly to the distribution system 34 via the feed pipe 42. In this embodiment, the separator is eliminated, and the vapor and liquid refrigerant mixture 24 flows directly into the distribution box 36. The vapor refrigerant 14 separates from the refrigerant 24 in the distribution box 36, as the liquid refrigerant 20 settles or is otherwise directed toward the bottom surface 44 of the distribution box 36. The vapor refrigerant 14 is flowed toward the vent 56 where it exits through the pressure regulator 58 into the housing 52 and is flowed toward the compressor 16. In this embodiment, the pressure regulator 58 is a variable orifice, or a vent valve (not shown). Varying flow through the pressure regulator 58 by these or other devices allows for control of a pressure in the distribution box 36 and thereby the flow of refrigerant into the distribution box 36 from the feed pipe 42 and out of the distribution box 36 via the drip openings 38.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A falling film evaporator for a heating ventilation and cooling (HVAC) system comprising:

a housing:

a plurality of evaporator tubes disposed at least partially in the housing through which a volume of thermal energy transfer medium is flowed; and a distribution system disposed in the housing to distribute a flow of liquid refrigerant over the plurality of evaporator tubes, the distribution system including:

a distribution vessel having a plurality of drip openings to flow the liquid refrigerant onto the plurality of evaporator tubes;

a feed pipe to flow refrigerant into the distribution vessel;

a separator disposed upstream of the distribution system to separate vapor refrigerant from liquid refrigerant, thereby outputting a flow of liquid refrigerant to the distribution vessel via the feed pipe, the feed pipe connecting the separator to the distribution vessel;

a suction port in the separator configured to output a flow of vapor refrigerant from the separator; and one or more pressure regulators in the distribution system, thereby regulating the flow of refrigerant, the one or more pressure regulators including:

a flow regulator at the suction port to regulate the flow of vapor refrigerant through the suction port; and a sensor operably disposed at the distribution vessel and operably connected to the pressure regulator to detect a liquid refrigerant level in the distribution vessel;

wherein the liquid refrigerant level exceeding a threshold results in stoppage of flow of vapor refrigerant through the suction port.

2. The falling film evaporator of claim 1, wherein the distribution vessel is configured to admit a mixture of a vapor and liquid refrigerant.

3. The falling film evaporator of claim 2, further comprising a vent pipe to vent vapor refrigerant from the distribution system.

4. The falling film evaporator of claim 3, wherein the vent pipe includes a metered vent orifice to regulate the flow of vapor refrigerant from the distribution system and thereby regulate the pressure in the distribution system.

5. The falling film evaporator of claim 4, wherein the metered orifice comprises a variable orifice.

6. The falling film evaporator of claim 4, wherein the metered orifice comprises a valved orifice.

7. The falling film evaporator of claim 3, wherein the vent pipe is disposed at the distribution vessel.

8. The falling film evaporator of claim 1, wherein the regulator is a damper disposed at the suction port.

9. The falling film evaporator of claim 1, wherein the sensor is a float disposed in the distribution vessel.

* * * * *